US008117956B2

(12) United States Patent
Emde

(10) Patent No.: US 8,117,956 B2
(45) Date of Patent: Feb. 21, 2012

(54) MAGAZINE FOR A HAND GUN

(75) Inventor: Dietmar Emde, Arnsberg (DE)

(73) Assignee: German Sport Guns GmbH, Ense-Höingen (DE)

( * ) Notice: Subject to any disclaimer, the term of this patent is extended or adjusted under 35 U.S.C. 154(b) by 170 days.

(21) Appl. No.: 12/777,297

(22) Filed: May 11, 2010

(65) Prior Publication Data

US 2011/0203448 A1 Aug. 25, 2011

(30) Foreign Application Priority Data

Feb. 24, 2010 (DE) ..... 10 2010 009 186

(51) Int. Cl.
*F41A 9/75* (2006.01)

(52) U.S. Cl. ..... 89/33.02; 89/33.17; 42/49.01

(58) Field of Classification Search ..... 89/33.01–33.5; 42/49.01, 19

See application file for complete search history.

(56) References Cited

U.S. PATENT DOCUMENTS

| | | | | |
|---|---|---|---|---|
| 2,131,412 | A | 9/1938 | Ostman | |
| 2,394,606 | A | 2/1943 | Gazda | |
| 2,321,720 | A * | 6/1943 | Whittaker | 42/50 |
| 4,332,097 | A * | 6/1982 | Taylor, Jr. | 42/50 |
| 4,926,742 | A | 5/1990 | Ma et al. | |
| 5,056,252 | A * | 10/1991 | Velezis | 42/50 |
| 5,456,153 | A | 10/1995 | Bentley et al. | |
| 7,806,036 | B2 * | 10/2010 | Cook et al. | 89/33.02 |
| 7,942,091 | B2 * | 5/2011 | Winge | 89/33.02 |
| 7,950,381 | B2 * | 5/2011 | Maeda | 124/51.1 |
| 8,037,800 | B2 * | 10/2011 | Snow | 89/33.02 |

FOREIGN PATENT DOCUMENTS

DE 2656680 A1 6/1978

* cited by examiner

*Primary Examiner* — Michael David
(74) *Attorney, Agent, or Firm* — Vern Maine & Associates

(57) ABSTRACT

The present invention relates to a magazine for a hand firearm, which is detachably mountable to the weapon, incorporating a drum-like, approximately cylindrical housing (10) which accommodates a greater number of cartridges in an orientation parallel to the axis of the housing, further incorporating an approximately spiral-shaped divider device (9), which is located inside the housing and accommodates the cartridges, a driver plate (14), which is adapted for indexed rotation about its axis and is driven by the force of a spring, said driver plate causing the cartridges to advance to the next position on a spiral path after each shot, and a follower (18) disposed in said magazine, which causes the cartridges to advance on their spiral path, to exit said divider device and to enter into a magazine head (21). In accordance with the invention, there is provided that the entire follower moves behind the last cartridge stored in the magazine on the spiral feeding path through the divider device, that said follower is not connected solidly to the driver plate but radially displaceably instead, and that said follower glides radially outward in a guide of the driver plate while being forwarded. In this way, the follower is prevented from jamming and trouble-free operation is ensured.

10 Claims, 12 Drawing Sheets

MAGAZINE FOR A HAND GUN

RELATED APPLICATIONS

This application claims priority from German Application No. DE 10 2010 009 186.3, filed Feb. 24, 2010, which is herein incorporated by reference in its entirety for all purposes.

FIELD OF THE INVENTION

The present invention relates to a magazine for a hand firearm, which is detachably mountable to the weapon, incorporating a drum-like, approximately cylindrical housing which accommodates a greater number of cartridges in an orientation parallel to the axis of the housing, further incorporating an approximately spiral-shaped divider device, which is located inside the housing and accommodates the cartridges, a driver plate, which is adapted for indexed rotation about its axis and is driven by the force of a spring, said driver plate causing the cartridges to advance to the next position on a spiral path after each shot, and a follower disposed in the magazine, which causes the cartridges to advance on their spiral path, to exit said divider device and to enter into a magazine head.

BACKGROUND OF THE INVENTION

What are referred to as drum magazines have long been known in prior art. In this context, the reader is referred to U.S. Pat. No. 2,131,412 for instance. Generally, said drum magazines incorporate a drum housing inside of which there is carried a greater number of for example 50 or more cartridges in an orientation parallel to the axis of the drum housing. The cartridges are conveyed on a spiral path by a follower into a magazine head, said follower advancing by the width of one cartridge after each shot via a mechanism operating under the action of a spring. A spiral spring that can be wound up in the fashion of a mainspring can be used as the spring for example. At need, the drum magazine may be attached to various types of weapons via an adapter.

Another drum magazine having the features of the type mentioned herein above is known from U.S. Pat. No. 4,926,742 A wherein the follower, whose one end engages behind the last cartridge in the magazine and pushes the cartridges on their spiral path through the housing, is articulated to the rotatable driver plate in the region of its other end. Thus, in principle, the head of the follower moves on the same spiral path as the cartridges while the end of the follower, which is articulated to the driver plate, always moves on an exterior circular path together with the driver plate, so that the angular position of the follower changes as a function of the filling level of the magazine. Since the mechanics used with this prior art drum magazine is quite complex, the feeding and ejection of the cartridges, which occurs in very short intervals when in use, may be subject to failures. In particular the introduction of forces is disadvantageous due to the pivotal attachment of the follower in the outer region of the driver plate. A force component is thus generated, which presses the follower outward against the wall of the divider device, thus causing friction forces to generate and possibly the follower to get jammed.

SUMMARY OF THE INVENTION

It is the object of the present invention to provide a magazine for a hand gun of the type mentioned herein above, which ensures failure-free movement of the feeding mechanics for the cartridges.

The solution to this object is a magazine for a hand gun of the type mentioned herein above, which has the characterizing features of the main claim.

In accordance with the invention, there is provided that the entire follower moves behind the last cartridge stored in the magazine on the spiral feeding path through the divider device, that the follower is not connected solidly to the driver plate but radially displaceably instead, and that said follower glides radially outward in a guide of the driver plate while being forwarded.

This implementation of the invention, in terms of construction, of essential components of the feeding mechanics, namely of the follower and of its attachment to the driver plate leads to an advantageous balance of forces. In the spiral feeding path, the follower moves so that the main force component acts in the feeding direction onto the respective last cartridge stored in the magazine. Forces acting outward upon the wall of the divider are avoided. When the cartridges, and together with them the follower, move through the spiral path of the divider on their feeding path, the follower progressively moves farther outward in the radial direction in its guide, thereby performing a kind of gliding movement. As contrasted with prior art, there is no longer any solid attachment point to which the follower is connected to the driver plate and which determines the forces acting onto the follower; instead, depending on the respective position of the follower on the spiral path on which the cartridges progressively move outward as the magazine is getting empty, the follower glides outward to the same extent in a guided movement. Accordingly, the forces applied by the follower always act in the feeding direction of the cartridges so that the follower is prevented from wedging or jamming.

According to a preferred developed implementation of the present invention, there is provided that the driver plate has a radial slot serving as a guide for the follower and in which the follower is hung for radial gliding movement. The radial width of the follower thereby approximately fits into the slot of the driver plate, which is of the same width; in an upper region for example, the width of the follower protrudes from said slot, though. If there remains enough clearance for the follower in the slot width, said follower can then glide radially outward in this slot as it progressively moves on the spiral path.

The follower may for example incorporate a plurality of links that are movably joined together or that are loosely disposed one behind the other in the spiral feeding path, said links being formed and dimensioned similar to a cartridge. In the first case mentioned, it is a kind of link chain that moves through the divider on said spiral path, in the feeding direction behind the cartridges stored in the magazine, the different links of the chain being linked together. According to the second alternative, it is also possible to use loose elements having approximately the shape of a cartridge, said elements however being blind cartridges without charge and primer and being of dimensions slightly larger than the cartridges themselves so that it is possible to prevent the elements of the follower from being ejected from the magazine through the magazine head.

According to a preferred developed implementation of the solution to the invention, the drum magazine of the invention is being used for cartridges having an ignition edge as they are being used for smaller weapon calibres. In this case, it is possible to suspend the cartridges from the top into slots of the driver plate during loading in such a manner that the ignition edge rests on a surface of the driver plate, while the remaining diameter of the cartridge, which is reduced with respect to the ignition edge, is accommodated in the slot. This allows for fast and simple loading of the magazine after which the cartridges are disposed in the slots so as to be oriented in the intended position, each slot of the driver plate only being capable to accommodate one cartridge in its width but several cartridges in the radial direction so that, when the magazine is full, the cartridges are positioned in individual rows in the driver plate, said rows extending radially from the inside toward the outside, each radially adjacent cartridge lying in another row of the spiral-shaped divider in such an individual row so that radially adjacent cartridges are separated from each other by a wall of the divider. By contrast, cartridges of two neighbouring slots, which are disposed next to each other in the circumferential direction, are separated from each other by webs of the driver plate that are disposed between two respective slots. Upon rotation of the driver plate, all the cartridges stored in the magazine are caused to move in the circumferential direction and are urged to the next position, a respective cartridge leaving the drum and being caused to enter the magazine head mounted to said drum.

A preferred developed implementation of the solution to the invention intends to dimension the diameter and/or the axial length of the various links of the follower so as to be slightly larger than the cartridges to be stored. In this embodiment, the cartridges can be forwarded one after the other from the drum to the magazine head until the follower has forwarded the last cartridge into the magazine head. The links or the various elements of the follower may then continue to forward the cartridges within the magazine head, this allowing to also evacuate the cartridges located in the magazine head. This process is repeated until the last cartridge has left the magazine head so that the magazine is completely empty. However, due to their dimensions and to a separate mechanism provided for this purpose, the links of the follower cannot leave the magazine head so that it is ensured that the links of the follower remain in the magazine head. Then, the magazine can be again loaded with cartridges.

In a preferred developed implementation of the invention there is provided that the magazine head is exchangeably fastened to the housing of the magazine through fastening means. The advantage thereof is that the magazine head can be exchanged and that the same drum magazine can be used for various types of weapons. The magazine head may be changed via a screw connection that may be untightened for example.

It is particularly preferred that the magazine incorporates a housing cover, which can be removed from the housing of the magazine, and that a loading plate is disposed between housing cover and driver plate.

The features mentioned in the dependent claims relate to preferred developed implementations of the solution to the invention. Other advantages of the invention will become apparent in the detailed description given herein after.

The present invention will be described herein after in closer detail, using exemplary embodiments thereof, with reference to the drawings.

DETAILED DESCRIPTION

Figure 1:
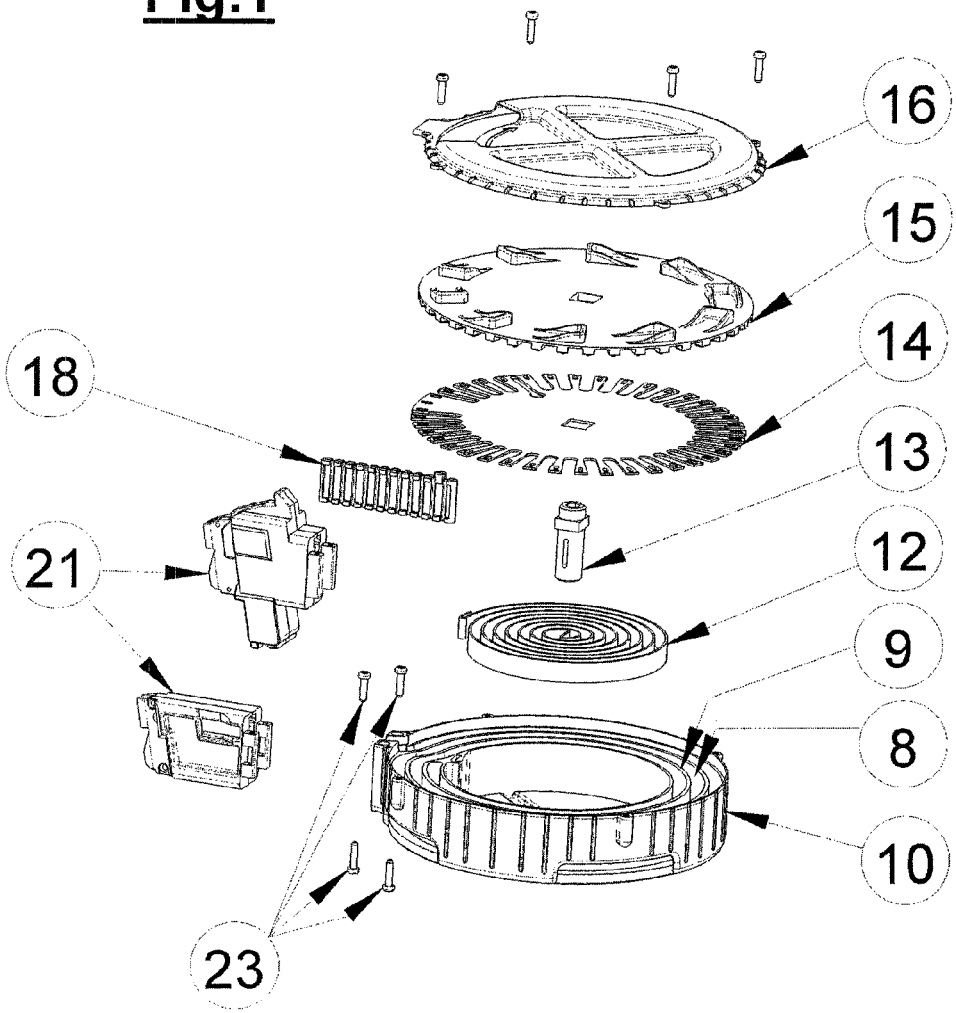
FIG. 1 shows a perspective exploded view of a drum magazine of the invention, given by way of example.

At first, reference is made to FIG. 1. The illustration shows an exploded perspective view of the essential component parts of a drum magazine of the invention. Said drum magazine incorporates an approximately cylindrical housing 10, a driving spring (torsion spring) 12, the function of which is similar to that of a mainspring and by means of which the drum magazine is caused to rotate in order to eject the cartridges. Further, there is provided a housing axis 13, a driver plate 14 with a great number of slots made on its circumference, a loading plate 15 as well as a housing cover 16 by means of which the housing 10 is closed at its top. A magazine head 21 is adapted to be detachably mounted to the housing 10 via fastening means 23, said magazine head being in turn mounted to the handle (not shown herein) of a weapon. The cartridges are ejected via the magazine head 21. The housing 10 has a divider device 9 with several partition walls forming a spiral arrangement. The cartridges are accommodated between these partition walls of the divider device 9 so that a spiral-shaped feeding path 8 forms on which the cartridges are transported from radially inside to radially outside until they are ejected from the drum housing 10 and enter the magazine head after having performed several complete movements about the circumference of the magazine in the region 7, where the magazine head 21 is mounted. In order to forward the cartridges on this spiral-shaped feeding path, they are guided almost one by one in the driver plate 14, a follower 18 being provided behind the last cartridge **20*a* which also moves on the approximately spiral-shaped feeding path for emptying the magazine, but moving behind the last cartridge 20*a* as far as into the magazine head 21 where it pushes said last cartridge out of the magazine head 21**.

Figure 2:
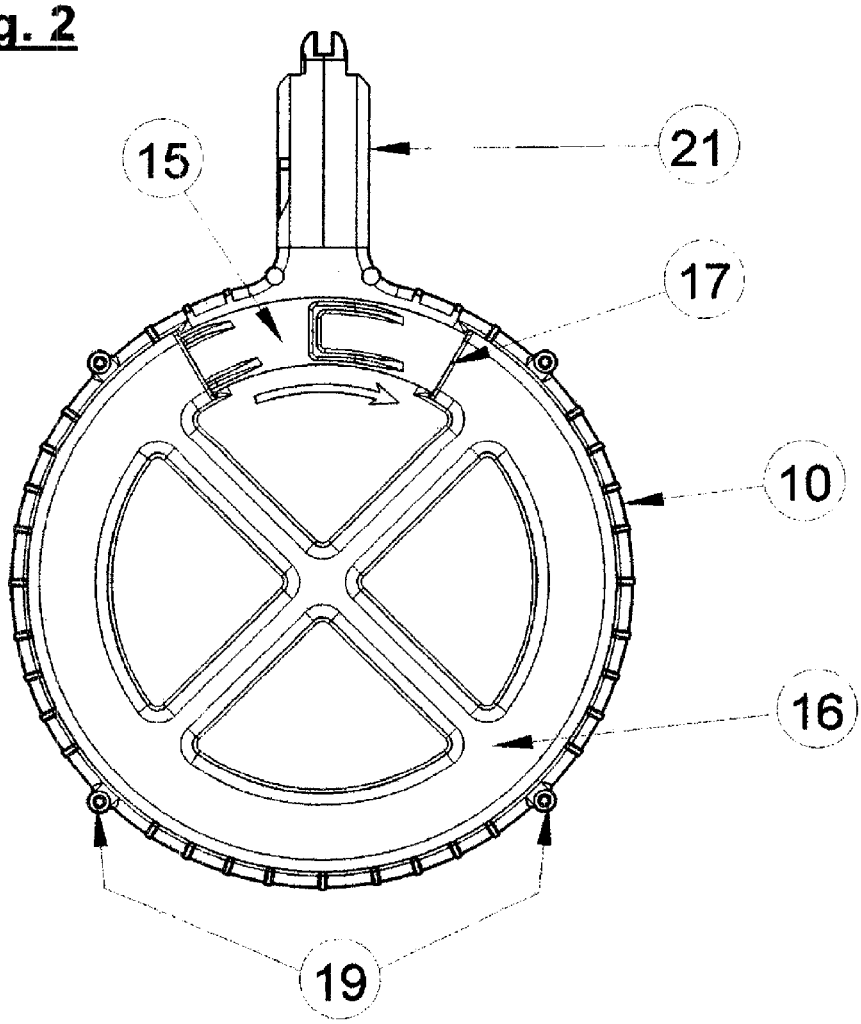
FIG. 2 shows a top view of a drum magazine of the invention, when mounted.

Herein after, reference will be made to FIG. 2, which shows a top view of an exemplary drum magazine in accordance with the present invention. It shows the closed housing 10 with a housing cover 16 from the top. It appears that this housing cover 16 has a recess 17 in the shape of a segment of a circle so that it is possible to look into the interior of the magazine in one segment and to view the loading plate 15 located underneath said housing cover 16. The driver plate 14 is rotated clockwise during loading by means of said loading plate 15 so that the cartridges 20 are allowed to glide into the slots 22 of the driver plate 14 and the magazine is wound up at the same time. One also sees the magazine head 21, which is fastened to the housing 10 and mounted to the firearm by pushing the magazine head 21 into a handle of the weapon for example. Moreover, FIG. 2 shows the four screws 19 by means of which the housing cover 16 is fastened; after having removed said screws, the housing cover 16 can be removed from the housing 10.

Figure 3:
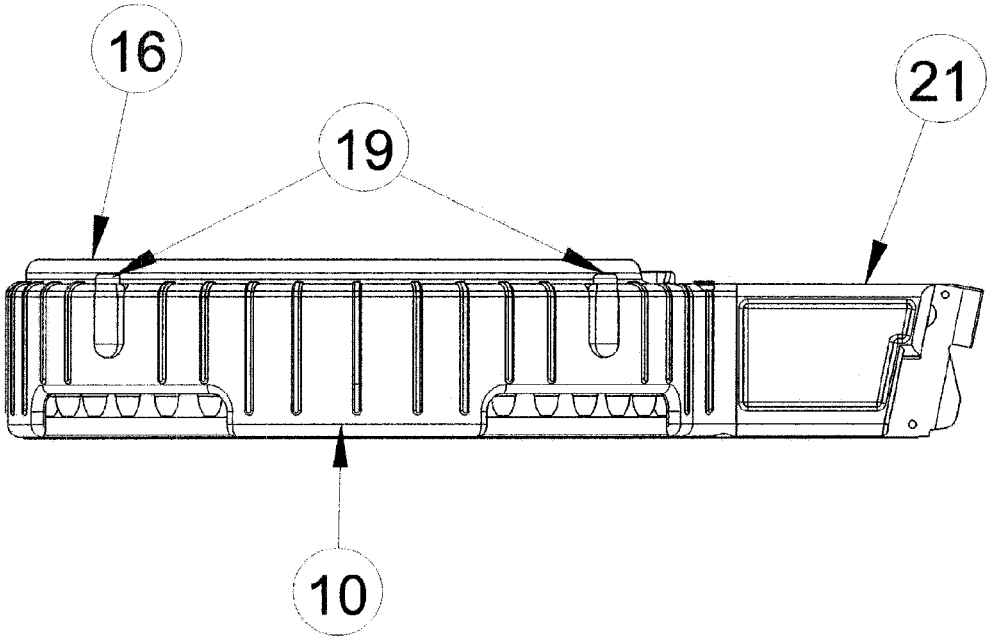
FIG. 3 shows a side view of the drum magazine shown in FIG. 2.
Figure 4:
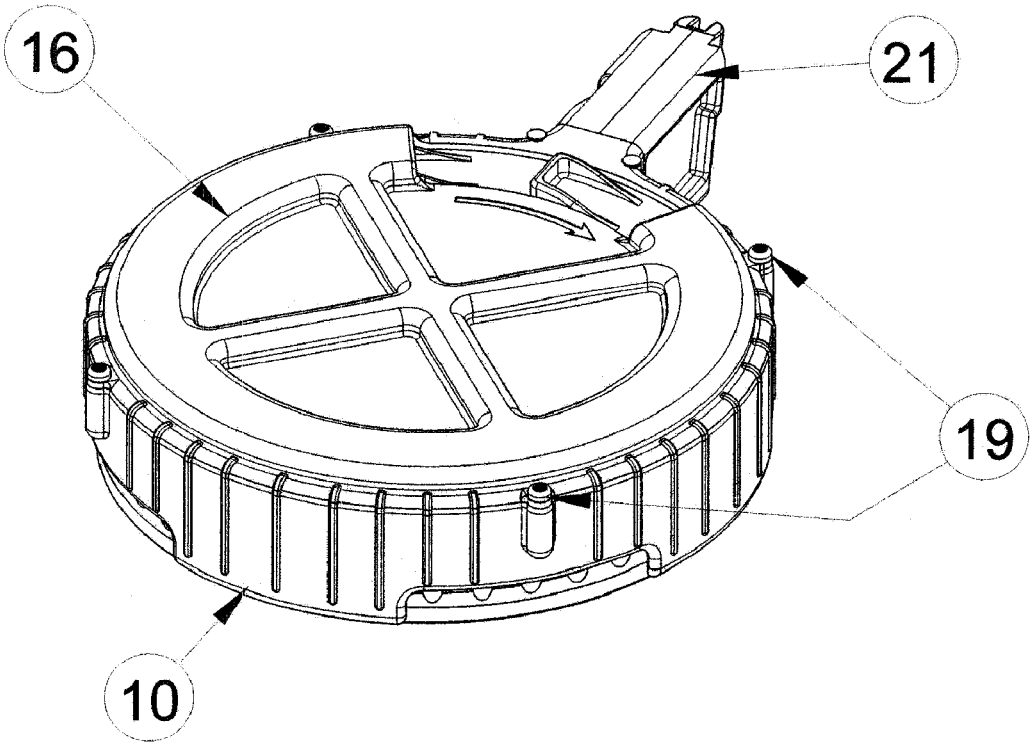
FIG. 4 shows a perspective view of the drum magazine of FIGS. 2 and 3.

The side view of the housing 10 as shown in FIG. 3 also shows the removable housing cover 16 and the magazine head 21, which is fastened to the housing, possibly so as to be exchangeable against another magazine head for another type of weapon.

Figure 5:
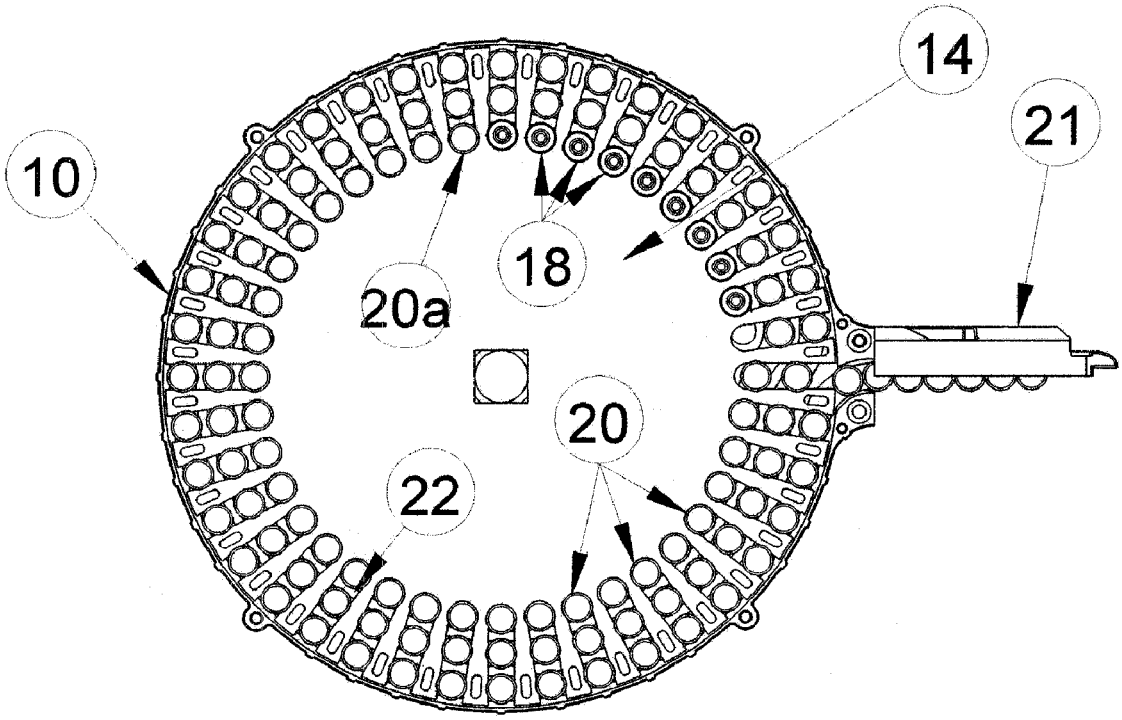
FIG. 5 is a top view of the housing of the magazine, which is open at the top and is loaded with a number of cartridges.

Referring now to the FIGS. 5 through 9, the function of the drum magazine of the invention will be discussed in closer detail herein after. FIG. 5 is a top view of the magazine filled with cartridges, once the housing cover 16 has been removed. It appears that the full magazine easily accommodates 110 cartridges 20, these cartridges having an ignition edge and being intended for a small-calibre weapon; they are hung by the ignition edge from the top into slots 22 of the driver plate 14. A plurality of such radially oriented slots 22 are provided, which are spaced a distance apart and which, in principle, extend over the entire circumference of the driver plate. The cartridges 20 are arranged such that several cartridges 20 are accommodated in a respective row in each of the slots 22. In the illustration shown in FIG. 6, the driver plate 14 was omitted so that it appears that the cartridges lie in the magazine in a generally almost spiral-shaped path, this being obtained by the partition walls of the divider device 9 (see also FIG. 1). These partition walls are the inner partition wall 9*a*, the partition wall 9*b*, which is parallel thereto and lies radially further toward the outside, the partition wall 9*c*, which in turn is parallel to the latter partition wall and which lies even further radially outside and the outermost partition wall 9*d*, which adjoins the outer housing wall. The two central partition walls 9*b* and 9*c* have an outward oriented offset at one point on the circumference, thus forming the almost spiral-shaped feeding path of the cartridges which thus migrate radially toward the outside as the magazine is emptying. Therefore, the cartridges 20 located in the innermost row are first located between the two partition walls 9*a* and 9*b*. After one complete revolution, the cartridges 20 then lie between the two central partition walls 9*b* and 9*c* in a central row that extends in turn over almost the entire circumference of the divider device 9. Finally, the cartridges 20 lie in an outermost row between the central partition wall 9*c* and the outer partition wall 9*d* until they finally enter into the magazine head 21. As a result, one obtains three rows of cartridges 20, the feeding path following an almost spiral-shaped path as the drum magazine empties progressively.

Figure 6:
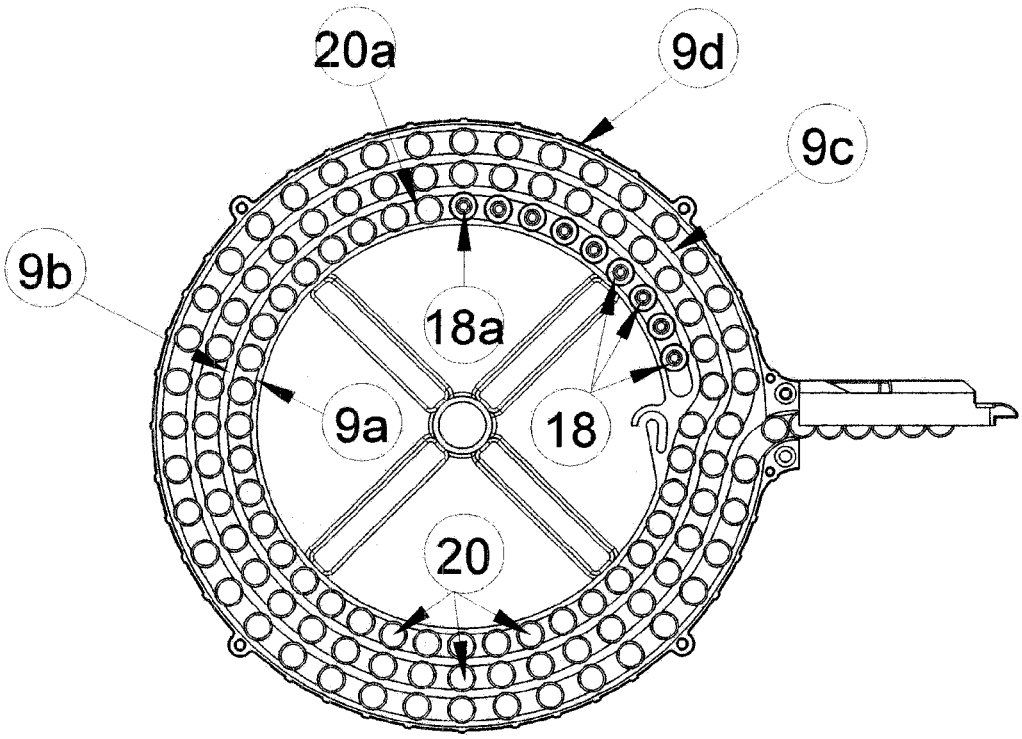
FIG. 6 is a view similar to FIG. 5, but with the driver plate omitted.

FIG. 6 also shows the follower 18, which in this variant consists of a number of cylindrical elements having approximately the dimensions of a cartridge 20 and moving like the cartridges 20 in the spiral-shaped feeding path, the follower 18 applying a pressure against the last cartridge 20*a* with its foremost element 18*a* when seen in the feeding direction. It appears from FIG. 5 that the elements of the follower 18 are respectively accommodated in the slots 22 of the driver plate 14 like the cartridges 20.

Figure 7:
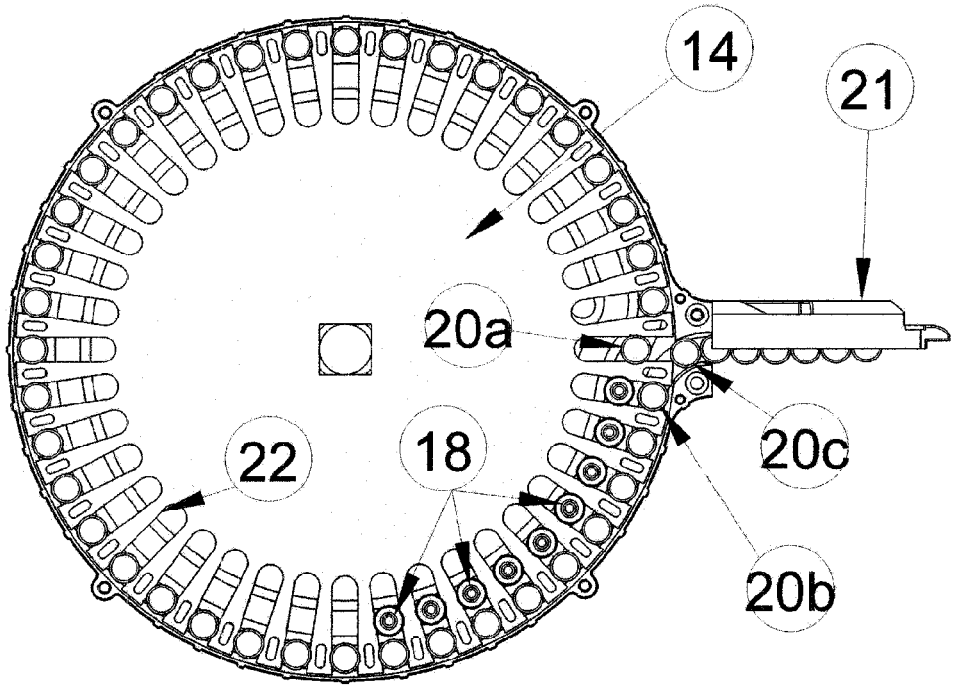
FIG. 7 is a view similar to FIG. 5 but in another position of the follower and with less cartridges in the magazine.
Figure 8:
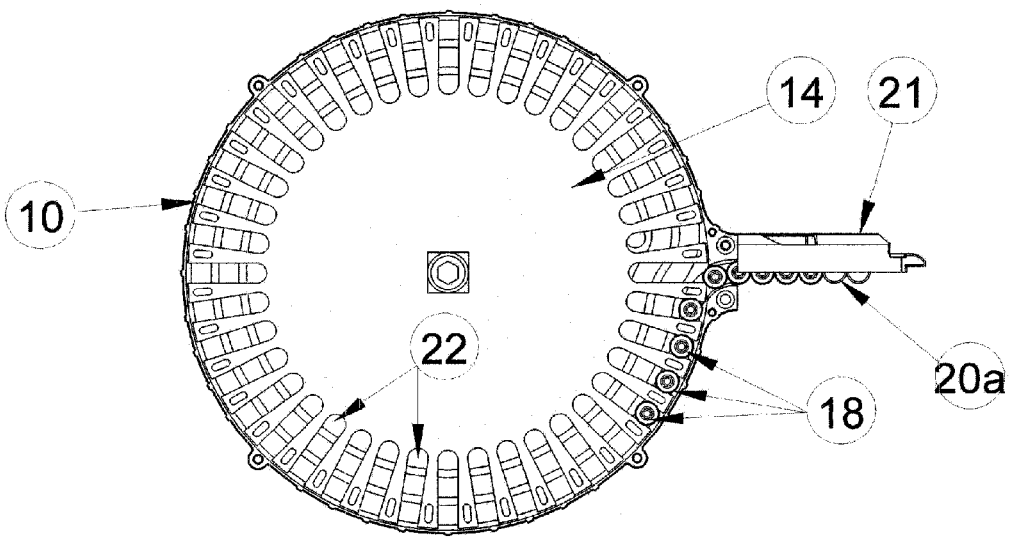
FIG. 8 is a view similar to FIG. 5 but again in another position of the follower and with the magazine almost empty.

The functioning of the magazine while emptying will be best understood when comparing the FIGS. 5, 7 and 8. It appears that the driver plate 14 has performed one complete and one three-quarter turn between the position shown in FIG. 5 and the one shown in FIG. 7. This is obvious from the respective position of the follower 18 and of the last cartridge 20*a*. In FIG. 7, said last cartridge is located in the region of the offset between the central and the outermost row of the feeding path. The cartridges which then leave the outermost row of the feeding path glide from the respective one of the slots 22 of the guide plate 14 and enter into a channel of the magazine head 21, where they fit snugly against each other as can be seen in FIG. 7 (see cartridges 20*b*, 20*c*). If one compares with the illustration shown in FIG. 8, the guide plate 14 has performed slightly more than one complete turn when compared with FIG. 7 so that now there are no cartridges left in the housing 10 of the drum magazine and that the follower 18 is still partially in the feeding path of the drum magazine while partially already being in the channel of the magazine head 21. The last cartridge 20*a*, which is provided with reference numerals in the FIGS. 5 and 7 as well, is located in the position shown in FIG. 8 already in the upper region of the magazine head 21 in which, as can be seen, there are only two cartridges left. Through the follower 18, all the cartridges can be ejected from the drum magazine and also from the magazine head 21. As can be seen from the comparison between the FIGS. 5 and 7, the elements 18 of the follower move progressively radially outward in the corresponding slots 22 of the driver plate 14 when said follower moves on the approximately spiral-shaped feeding path.

Figure 9:
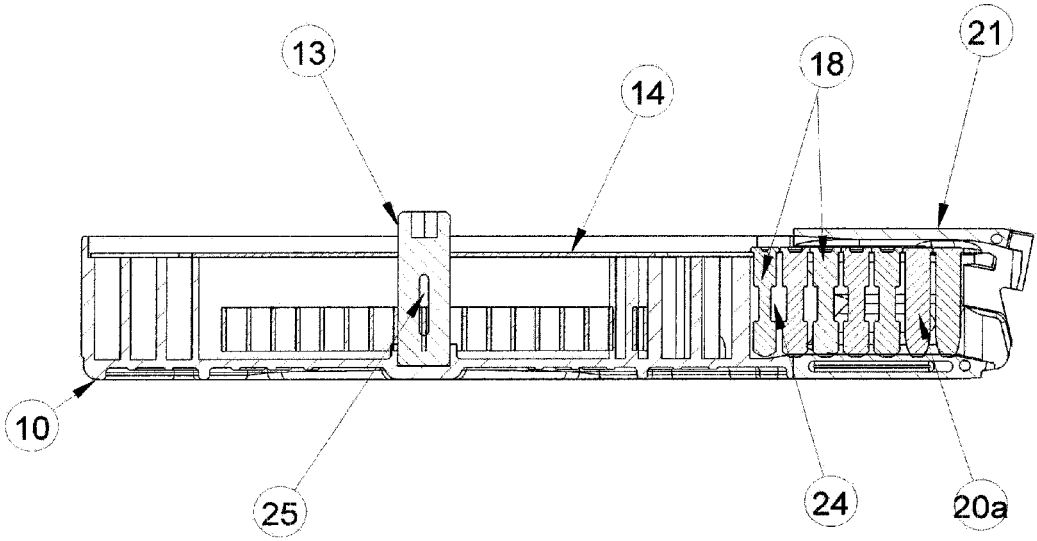
FIG. 9 is a sectional view of the empty magazine according to the position shown in FIG. 8.

As can be seen from FIG. 9, the discrete elements of the follower 18 are of a design which is slightly different from that of the cartridges 20. The elements of the follower have another geometry than a cartridge 20, here for example a central constriction 24, so that they are narrower than the cartridges 20 in their center, this only by way of example, an appropriate mechanism or a suited geometry allowing to prevent the elements 18 of the follower from leaving the magazine head 21. In FIG. 9, it also appears that both the cartridges 20 and the elements of the follower 18 are hung in the driver plate 14 so that these elements slightly protrude toward the top. The ignition edge of the cartridges 20 in the magazine therefore lies on the top surface of the driver plate 14.

In the sectional view through the housing 10 of the drum magazine as shown in FIG. 9, the driving spring 12, which is also shown in FIG. 1, and which functions like a mainspring and causes the driver plate 14 to rotate about its axis after biasing can also be seen. For this purpose, the driving spring 12 is carried on the axis 13 and is retained in this axis in a slot by one end for example.

Figure 10:
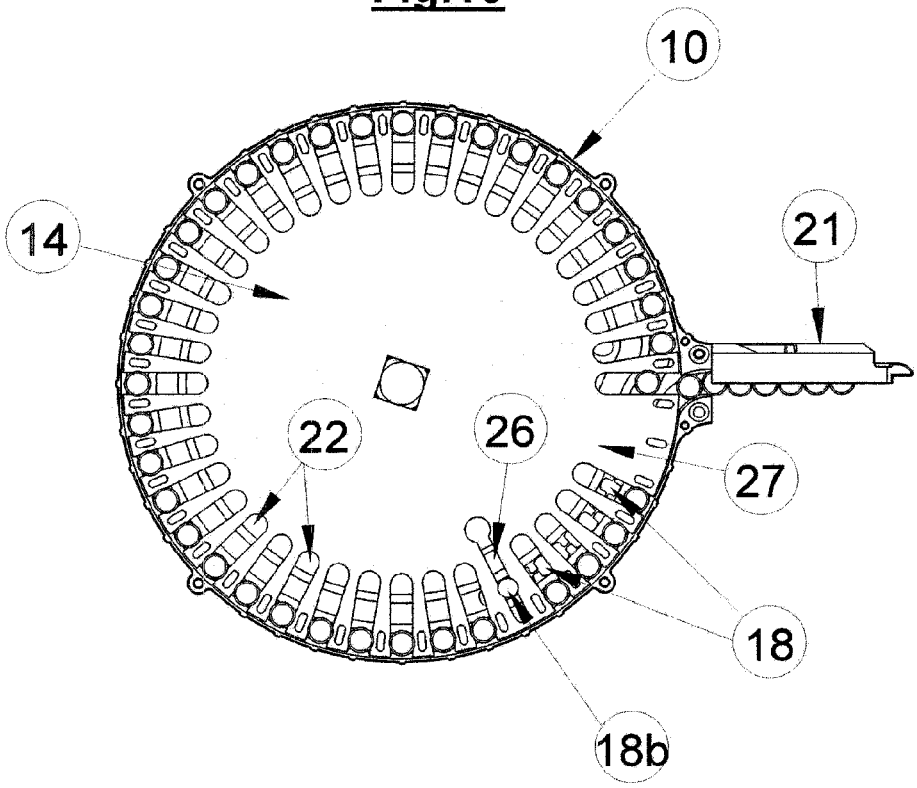
FIG. 10 is a top view of the housing open at the top of a partially filled magazine according to an alternative implementation variant of the invention, slightly amended.
Figure 11:
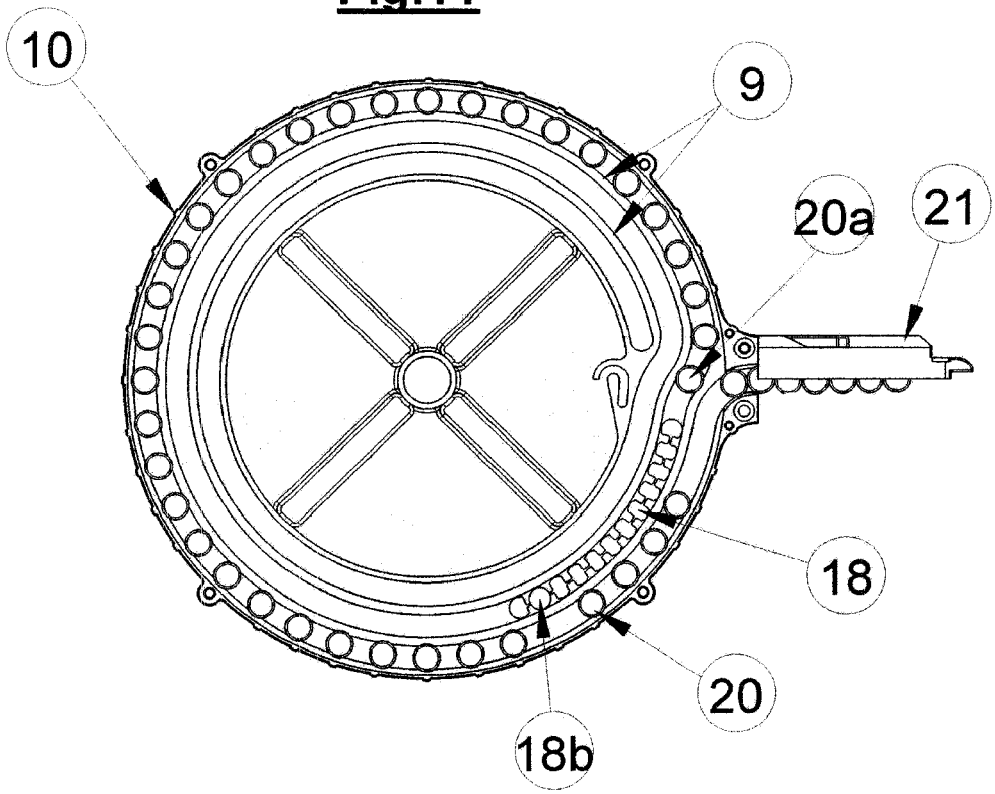
FIG. 11 is a corresponding top view like in FIG. 10, but without the driver plate.
Figure 12:
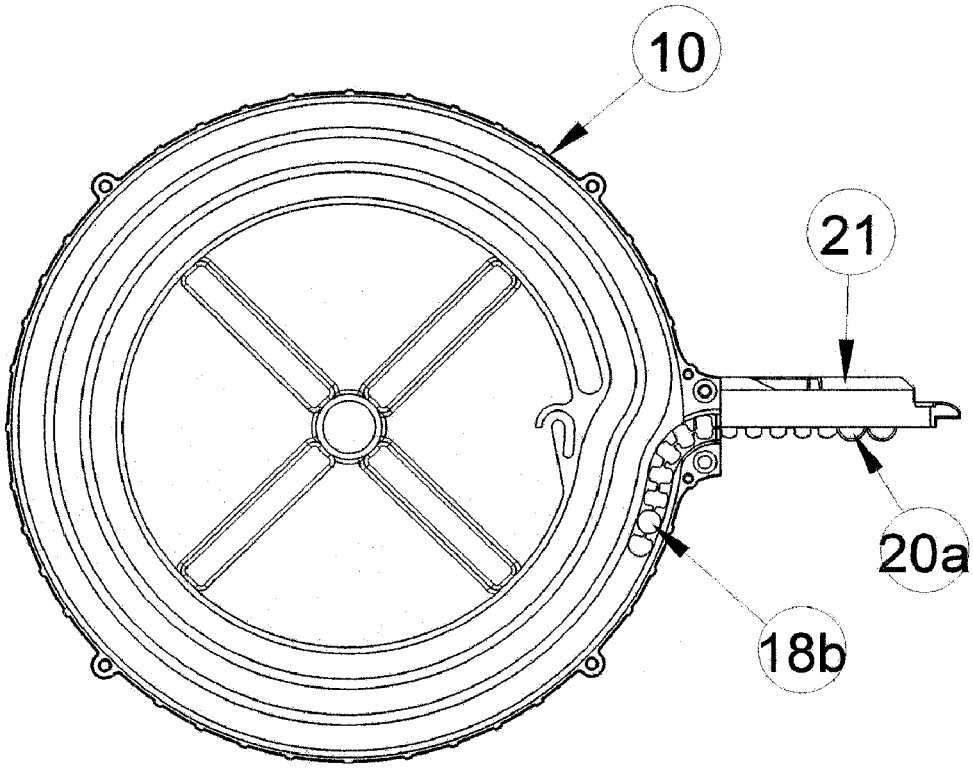
FIG. 12 is a view similar to FIG. 11, but with the drum magazine empty.

Referring to the FIGS. 10 to 12, a slightly amended implementation variant of the present invention will be described herein after. This variant differs from the exemplary embodiment described herein above by the configuration of the follower 18. Here, the elements are not discrete, loose elements; instead, the elements of the follower 18 are linked together to form a unit like a link chain, said unit urging the cartridges 20 on their approximately spiral-shaped feeding path through the divider device toward the magazine head 21. In FIG. 11, the follower 18 is particularly visible since the driver plate 14, which is disposed on top of it when the magazine is mounted, has been omitted therein whilst in FIG. 10 the driver plate 14 is shown so that the follower 18 can only be seen in parts. Both illustrations show a position of the follower 18 in which the drum magazine is only partially filled with cartridges 20. Again, the last cartridge 20*a* in the feeding path is indicated at 20*a*. This cartridge is located in a position in which it lies in the region of the offset and in which it moves from the central to the outer circumferential row of the feeding path. The follower 18 consists of several elements of like configuration although it also has elements of a slightly different configuration that are located at its respective ends as well as an element 18*b* (see FIG. 10) which serves to fasten the follower 18 inside a slot 26 of the driver plate 14 by suspending it therein.

As can be seen from FIG. 10, there is a difference between the follower plate 14 and the variant described herein above since said plate has a slightly wider web 27 at one point of the circumference between two slots 22 that are open toward the outside so that the distance between these two slots 22 is slightly greater. Accordingly, the time needed for the next cartridge 20 to enter into the magazine head 21 is minimally longer when the driver plate 14 passes this point to which the magazine head 21 is mounted during its movement of rotation. At this point, the cartridges 20 then leave the outermost of the circumferential rows of the divider device 9 and move from the slightly spiral-shaped feeding path into the channel of the magazine head 21 (see FIG. 11). FIG. 12 shows the position with the empty drum magazine in which the driver 18 has performed slightly more than one additional turn as compared with the position shown in FIG. 11 and in which the last cartridge 20*a* already is in the magazine head 21 which it leaves shortly thereafter. In FIG. 12 it can be seen that the follower 18 with its linked elements (links) migrates into the channel of the magazine head so that all the cartridges 20 can be evacuated from the magazine. When the follower 18 moves through the divider device 9 behind the cartridges 20 on the feeding path as the magazine is getting empty, the element 18*b* of the follower 18 glides progressively outward in the slot 26 in which the follower 18 is fastened.

LIST OF NUMERALS

8 spiral-shaped feeding path
9 divider device
10 housing
12 driving spring
13 axis
14 driver plate
15 loading plate
16 housing cover
17 recess
18 follower
18*b* fastened element of the follower
19 screws
20 cartridges
20*a* last cartridge
21 magazine head
22 slots
23 fastening means
24 constriction
25 slot
26 slot
27 web

What is claimed is:

1. A magazine for a hand firearm, which is detachably mountable to the weapon, incorporating a drum-like, approximately cylindrical housing which accommodates a greater number of cartridges in an orientation parallel to the axis of the housing, further incorporating an approximately spiral-shaped divider device, which is located inside the housing and accommodates the cartridges, a driver plate, which is adapted for indexed rotation about its axis and is driven by the force of a spring, said driver plate causing the cartridges to advance to the next position on a spiral path after each shot, and a follower disposed in said magazine, which causes the last cartridges to advance into the magazine head, thus effecting the evacuation thereof into a magazine head, wherein the entire follower moves behind the last cartridge stored in the magazine on the spiral feeding path through the divider device, that said follower is not connected solidly to the driver plate but radially displaceably instead, and said follower glides radially outward in a guide of the driver plate while being forwarded.

2. The magazine for a hand firearm as set forth in claim 1, wherein the driver plate comprises at least one radial slot as a guide for the follower in which slot said follower is suspended for radial gliding movement.

3. The magazine for a hand firearm as set forth in claim 2, wherein the follower incorporates a plurality of elements or links that are movably joined together or that are loosely disposed one behind the other in the spiral feeding path, said elements or links being formed and dimensioned similar to a cartridge.

4. The magazine for a hand firearm as set forth in claim 2, wherein the discrete links of the follower have sizes in diameter and/or in axial length that differ from those of the cartridges to be stored in the magazine.

5. The magazine for a hand firearm as set forth in claim 2, wherein, in the region of the magazine head, there is provided a mechanism or a geometry that prevents discrete links of the follower from exiting the magazine head while the weapon is in operation.

6. The magazine for a hand firearm as set forth in claim 1, wherein the driver plate has on its outer circumference a plurality of radially oriented, spaced apart slots whose width approximately corresponds to the diameter of a respective cartridge.

7. The magazine for a hand firearm as set forth in claim 1, wherein said magazine is intended for cartridges having an ignition edge and that, for charging the magazine, the cartridges may be hung into the slots of the driver plate in such a manner that their ignition edges rest upon the surface of the driver plate whilst the cartridge fittingly engages the respective one of the slots underneath said ignition edge.

8. The magazine for a hand firearm as set forth in claim 1, wherein the magazine head is exchangeably fastened to the housing of the magazine through fastening means.

9. The magazine for a hand firearm as set forth in claim 8, wherein the magazine head is detachably fastened to the housing of the magazine through a screw, plug or clamping connection and may be replaced by a magazine head adapted to another weapon.

10. The magazine for a hand firearm as set forth in claim 1, wherein a loading plate is interposed between housing cover and driver plate.

* * * * *